United States Patent [19]

Asplund et al.

[11] Patent Number: 4,621,584

[45] Date of Patent: Nov. 11, 1986

[54] METHOD AND DEVICE FOR FIRING SOLID FUELS, MAINLY IN THE FORM OF LUMPS OR PIECES

[76] Inventors: Frank E. W. Asplund, Dalbovägen 15, Sollentuna S-191 45; Ulrika M. Jantze, Gotlandsgatan 74, Stockholm S-116 38, both of Sweden

[21] Appl. No.: 752,340

[22] PCT Filed: Oct. 17, 1984

[86] PCT No.: PCT/SE84/00342

§ 371 Date: Jun. 24, 1985

§ 102(e) Date: Jun. 24, 1985

[87] PCT Pub. No.: WO85/02007

PCT Pub. Date: May 9, 1985

[30] Foreign Application Priority Data

Oct. 24, 1983 [SE] Sweden ..... 8302684

[51] Int. Cl.[4] ..... F23D 1/00

[52] U.S. Cl. ..... 110/347; 110/214; 110/259; 110/269; 110/329

[58] Field of Search ..... 110/269, 108, 110, 329, 110/109, 259, 229, 347, 214

[56] References Cited

U.S. PATENT DOCUMENTS

| | | | |
|---|---|---|---|
| 1,110,642 | 9/1914 | Hisbet | 110/109 |
| 1,960,718 | 5/1934 | Standifer et al. | 110/269 X |
| 2,476,567 | 7/1949 | Sparks . | |
| 2,592,730 | 4/1952 | Perkins | 110/229 |
| 3,358,625 | 12/1967 | Jones . | |
| 3,599,610 | 8/1971 | Spector | 110/229 X |

FOREIGN PATENT DOCUMENTS

| | | |
|---|---|---|
| 3149548 | 6/1983 | Fed. Rep. of Germany . |
| 1075077 | 10/1954 | France . |
| 181676 | 11/1962 | Sweden . |
| 20573 | of 1891 | United Kingdom . |
| 26169 | of 1909 | United Kingdom . |

*Primary Examiner*—Edward G. Favors

*Attorney, Agent, or Firm*—Pollock Vande Sande & Priddy

[57] ABSTRACT

Method and device for firing solid fuels, substantially in the form of lumps or pieces, in a furnace having a combustion chamber (1) with a sustantially horizontal bottom (10), upon which is maintained a fuel bed (3) with relatively great thickness while supplying fuel within the very bed (3), through which bed primary combustion air is fed from below through mutually spaced primary air passages (18) in the combustion chamber bottom (10), the combustion gas which leaves said chamber (1) furthermore being subjected to a subsequent secondary combustion in a secondary combustion chamber after addition of secondary combustion air. In order to provide for a mechanical removal of ash the invention suggests that the fuel is supplied into the bed positively and intermittently at a position on an end wall of said combustion chamber (1) at a vertical height spaced above the bottom (10) of the latter but below the upper surface of the fuel bed during operation of the furnace and substantially in horizontal direction, whereby at each occasion newly supplied fuel provides an agitation of the bed (3) such that a concentrated combustion zone is obtained at the upper portion of the bed while finally combusted fuel in the form of ash is progressively moved towards the opposite end wall of the combustion chamber (1) and downwards and along the combustion chamber bottom (10), wherefrom the ash is removed in horizontal direction during furnace operation.

2 Claims, 2 Drawing Figures

METHOD AND DEVICE FOR FIRING SOLID FUELS, MAINLY IN THE FORM OF LUMPS OR PIECES

BACKGROUND OF THE INVENTION

The present invention refers to a method and a device for firing solid fuels, substantially in the form of lumps or pieces, in a furnace having a combustion chamber with a substantially horizontal bottom, upon which is maintained a fuel bed with relatively great thickness while supplying fuel within the very bed, through which bed primary combustion air is fed from below through mutually spaced primary air passages in the combustion chamber bottom, the combustion gas which leaves the chamber furthermore being subjected to a subsequent secondary combustion in a secondary combustion chamber after addition of secondary combustion air.

Combustion methods and devices of this kind are previously known and it is also known to fire such furnaces with insufficient supply of primary air, which implies that above the fuel bed is formed an energy-rich gas which after admixing with secondary air is burnt in a secondary combustion chamber. A problem in connection with firing methods and devices of this kind resides in the removal of ash and slag from the combustion chamber. Conventionally, the bottom of the combustion chamber is constituted by a grid-like grate through which primary air is supplied. Ash and slag have to be removed by hand after stopping the fuel supply and complete down-burning of the fuel bed.

Another problem in connection with previously known firing methods and furnaces of the above-stated kind is that it is extremely difficult to obtain a uniform distribution of the primary air flow over the entire cross section of the combustion chamber. This leads to a non-uniform combustion and impaired efficiency.

Partly, the above-stated problems are dependent on each other since the formation of slag within one area of the combustion chamber cross section causes an impaired air flow within said area such that the air distribution becomes non-uniform. This causes an unsuitable combustion temperature and slag formation.

SUMMARY OF THE PRESENT INVENTION

The main object of the present invention is to eliminate the above problems and to provide for effective removal of ash and other combustion residues and provide uniform distribution of the primary air flow of the entire cross section of the combustion chamber. According to the method of the present invention this is obtained by supplying fuel into the bed positively and intermittently at a position on an end wall of the combustion chamber at a vertical height spaced above the bottom of the latter but below the upper surface of the fuel bed during operation of the furnace and substantially in horizontal direction, whereby at each occasion newly supplied fuel provides an agitation of the bed such that a concentrated combustion zone is obtained at the upper portion of the bed while finally combusted fuel in the form of ash is progressively moved towards the opposite end wall of the combustion chamber and downwards and along the combustion chamber bottom, wherefrom the ash is moved in horizontal direction during furnace operation.

The invention also provides for a device for carrying out the inventive firing method in a furnace having a substantially horizontal bottom, upon which is maintained a fuel bed with relatively great thickness. Fuel is supplied within the bed, and primary combustion air is fed from below through the combustion chamber bottom. The chamber bottom consists of a plurality of mutually substantially parallel beams, which extend over the whole width of the combustion chamber and which are mutually spaced so as to form gaps therebetween. The combustion chamber in its upper portion furthermore has an orifice for admixing secondary air to the combustion gas leaving the combustion chamber in order to carry out a subsequent secondary combustion in a secondary combustion chamber. According to the present invention the device is distinguished in that the fuel supply inlet is located at a position on an end wall of the combustion chamber at a vertical height spaced above the bottom of the latter but below the upper surface of the fuel bed during the furnace operation and adapted to supply fuel positively and intermittently and substantially in horizontal direction and in that the beams are arranged horizontally movable in parallel by associated endless conveying means driven by a drive device in order to provide for a mechanical ash removal during the operation of the furnace.

By way of example, the invention will be further described below with reference to the accompanying drawings, in which:

DESCRIPTION OF THE PREFERRED EMBODIMENTS

Figure 1:
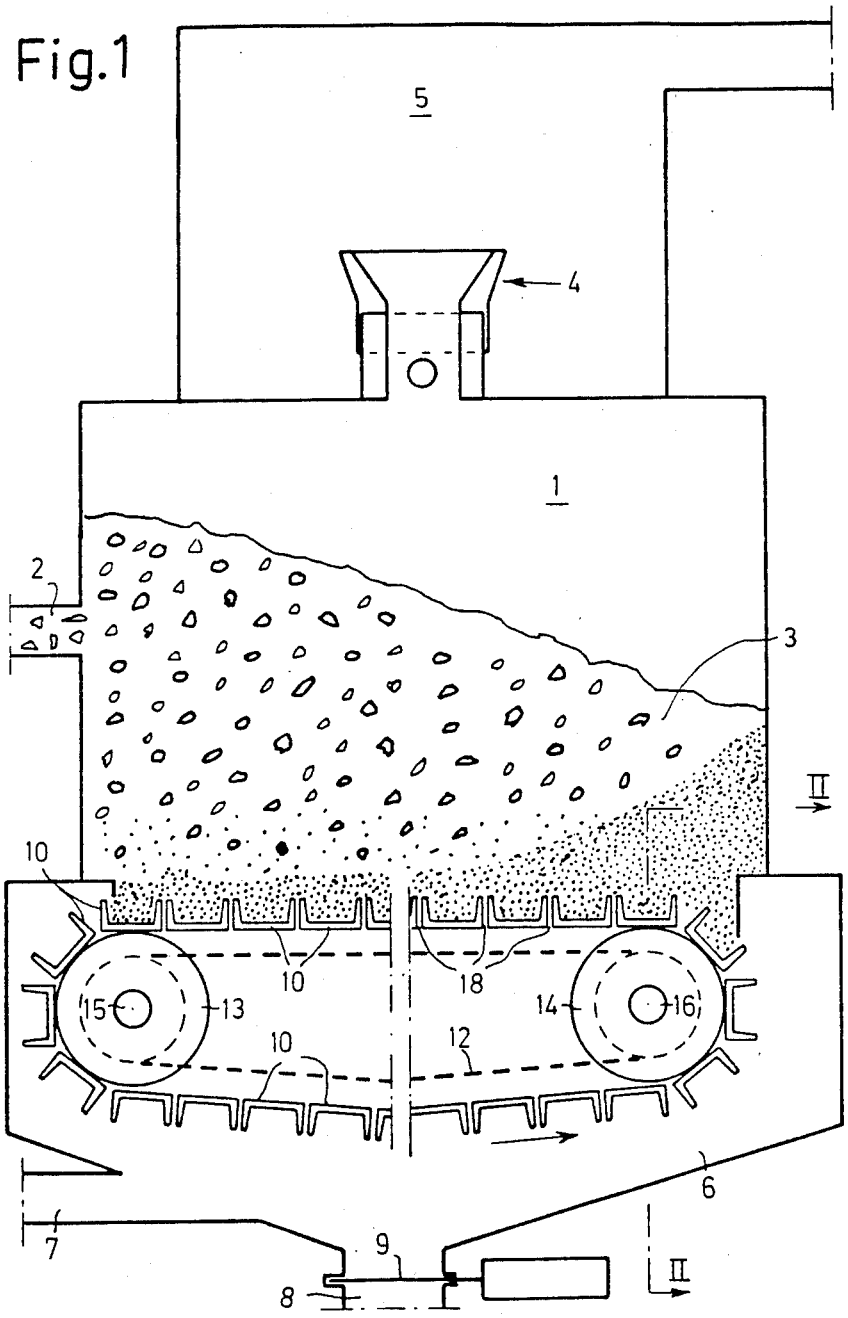
FIG. 1 is a diagrammatical cross section of a furnace with a device according to an embodiment of the invention and FIG. 2 is a section along the line II—II in FIG. 1.

In FIG. 1 is illustrated a furnace for firing solid fuels, substantially in the form of lumps or pieces. The furnace comprises a combustion chamber 1 which is provided with an inlet 2 at one of its end walls for supplying fuel at a relatively high level in the chamber 1. A fuel bed 3 of relatively great thickness may be provided, with combustion being adapted to take place in the upper portion of the fuel bed 3 while the lower portion of the bed provides good distribution of the primary air to the upper portion. At the upper end of the combustion chamber 1 there is an orifice 4 in which secondary air is mixed with the gas from the combustion chamber 1, the secondary combustion being carried out in a secondary combustion chamber 5, into which the orifice 4 opens.

At its lower end the combustion chamber 1 merges into a primary air box 6, to which primary air is fed through a primary air duct 7. The lower portion of the air box 6 simultaneously serves as an ash discharge hopper and an ash outlet 8 with a valve arranged at the lower end of the box.

Figure 2:
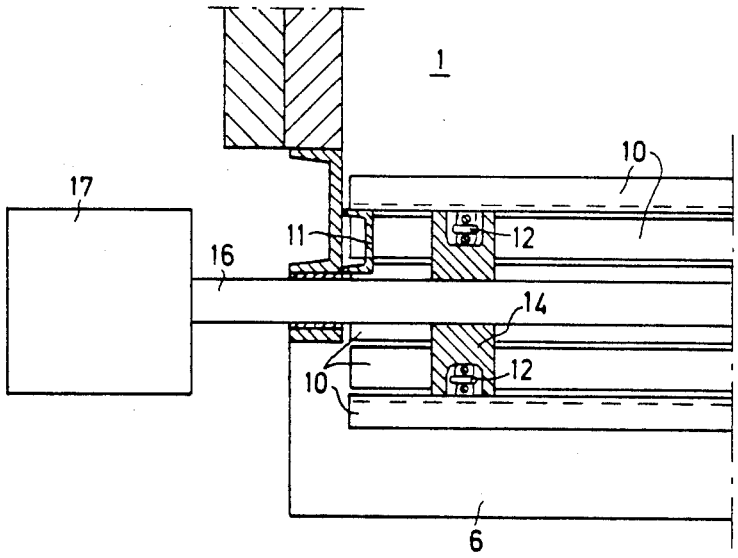

At the position of merger between the combustion chamber 1 and the air box 6 is located a device for discharging ash and distributing the primary air. This device which is also illustrated in FIG. 2, comprises in the embodiment illustrated a plurality of mutually parallel U-beams 10, which have a length such that they extend over the whole width of the combustion chamber 1. As is evident from FIG. 2 the ends of U-beams 10 are supported by support beams 11 which are mounted along the sides of the combustion chamber 1. In a suitable way such as by welding the U-beams 10 are connected with two endless conveyor chains 12 of which only one has been illustrated in the drawings. Chains 12 run over sprockets 13 and 14 which are supported on shafts 15 and 16, respectively. The shaft 16 is driveable by means of a drive device 17 which comprises a drive motor and a suitable reduction gear. The dimensions of the U-beams 10 and their mutual spacing are selected such that the gaps 18 between the beams have a width and mutual spacing that the distribution of primary air supplied through the duct 7 becomes uniform over the entire cross section of the combustion chamber 1.

When firing solid fuels in a furnace according to the present invention fuel is intermittently fed into the fuel bed 3 through the substantially horizontal fuel inlet 2 and primary air is supplied through the duct 7 and distributed through the gaps 18 between the U-beams 10.

Hence, the fuel will move progressively from left to right in FIG. 1 of the drawings and will then be preheated and dried such that moisture present in the fuel, particularly as far as coal is concerned, is evaporated. The steam thus evaporated will be carried obliquely upwardly to the right by the primary air towards a concentrated intense combustion zone in the upper portion of the fuel bed 3 and substantially in the middle or slightly to the right of the middle in FIG. 1 of the drawings, where steam contributes to the improvement of the gasifying of the fuel. The positive feeding of the solid fuel through the inlet 2 at a relatively high level but still below the upper surface of the fuel while the operation of the furnace as is evident from FIG. 1 of the drawings also implies an agitation and raising of the fuel bed closest to the inlet. By the intense combustion more forwardly or to the right within the upper portion of the bed the upper surface of the bed will progressively sink in this direction, however, at the same time as the amount of ash of course increases rapidly in the same direction. The slope of the upper surface of the bed implies that when supplying new fuel through the inlet 2 burning fuel will carry out an orbiting or rolling motion progressively towards the right end of the furnace.

In the ash removal the drive device 17 drives the chains 12 and thus also the U-beams 10 which then move in an endless path, the upper portion of which is arranged such that in this location the beams form the bottom of the combustion chamber 1. During their movement the beams will progressively scrape away the lowermost layer of the fuel bed which has been burnt to ash. When the beams 10 pass over the sprocket 13 the ash and combustion residues will fall down into the ash discharge hopper in the air box 6.

The surprisingly good operation of the firing method and furnace according to the invention thus resides both in the uniform primary air distribution resulting from design of the combustion chamber bottom in the form of mutually parallel beams 10 and in the particular feeding of the solid fuel through a horizontally directed fuel inlet 2 located at one of the end walls of the combustion chamber 1 at a vertical level spaced above the combustion chamber bottom 10 but below the upper surface of the fuel bed during furnace operation.

The firing method and the device according to the invention might be automated as is known in the art, for example by means of level transducers which detect a predetermined uppermost and/or lowermost level of for instance the upper said surface at the middle of the length of the combustion chamber 1, such that at too low a level the fuel feed through the inlet 2 is started but stopped when a predetermined uppermost fuel bed level is detected. In its turn, the ash removal might be automated by means of a detection of the primary air pressure drop through the bed 3, for instance such that when the pressure drop from the primary air inlet through the bed and to a point above bed 3 in the combustion chamber 1 exceeds a predetermined value a control signal is formed by means of well-known equipments for bringing the ash removal device with the parallel U-beams 10 to start removing ash. By this time combustion has formed so much ash which has been compressed to such an extent that the throughflow of primary air is obstructed.

The invention is not limited to the above-described embodiment but changes might be made within the scope of the accompanying claims.

We claim:

1. A device for carrying out a method for firing solid fuels, in the form of particles in a furnace having a subsantially horizontal bottom, upon which is maintained a fuel bed with relatively great thickness while supplying fuel within the fuel bed, through which primary combustion air is fed from below through the combustion chamber bottom, which consists of a plurality of mutually substantially parallel beams, which extend over the whole width of the combustion chamber and which are mutually spaced so as to form gaps therebetween, said combustion chamber in its upper portion furthermore having an orifice for admixing secondary air to the combustion gas leaving the combustion chamber in order to carry out a subsequent secondary combustion in a secondary combustion chamber, wherein the fuel supply inlet is located at a position on an end wall of the combustion chamber at a vertical height spaced above the bottom of the latter but below the upper surface of the fuel bed during the furnace operation and adapted to supply fuel positively and intermittently and substantially in a horizontal direction, and in that the beams are arranged horizontally movable in parallel by associated endless conveying means driven by a drive device in order to provide for a mechanical ash removal during the operation of the furnace.

2. A method for firing solid fuels in the form of particles comprising the steps of maintaining a fuel bed with relatively great thickness in a combustion chamber having a substantially horizontal bottom;

introducing fuel within the fuel bed positively and intermittently in substantially a horizontal direction through a side wall of the combustion chamber at a position above the bottom of the chamber and below the upper surface of the fuel bed, the introduction of the fuel providing an agitation of the fuel thereby providing a concentrated combustion zone at the upper position of the fuel bed;

feeding the fuel bed with primary combustion air through a plurality of spaced apart passages in the combustion chamber bottom;

moving combustion gas upwardly and subjecting combustion gas with secondary combustion air in the secondary combustion chamber;

progressively moving combusted fuel in the form of ash toward the opposite wall of the chamber and downwardly along the chamber bottom; and removing the ash horizontally from the botton during the operation of the furnace.

* * * * *